US006719256B2

(12) United States Patent
Rydell et al.

(10) Patent No.: US 6,719,256 B2
(45) Date of Patent: Apr. 13, 2004

(54) FURNITURE LEG GLIDE

(75) Inventors: Jan Rydell, Majgårdsgatan (SE); Tomas Eriksson, Örbylund (SE)

(73) Assignee: Produktutveckling I Sverige Hb, Limmared (SE)

( * ) Notice: Subject to any disclaimer, the term of this patent is extended or adjusted under 35 U.S.C. 154(b) by 0 days.

(21) Appl. No.: 10/217,597

(22) Filed: Aug. 13, 2002

(65) Prior Publication Data

US 2002/0190179 A1 Dec. 19, 2002

Related U.S. Application Data

(63) Continuation of application No. PCT/SE01/00299, filed on Feb. 14, 2001.

(30) Foreign Application Priority Data

Feb. 15, 2000 (SE) ..... 0000470

(51) Int. Cl.[7] ..... B65D 19/00
(52) U.S. Cl. ..... 248/346.11; 248/188.9
(58) Field of Search ..... 248/188.9, 188.8, 248/346.11; 108/156, 190, 186

(56) References Cited

U.S. PATENT DOCUMENTS 619,235 A * 2/1899 Schwarting ..... 135/80
1,334,208 A * 3/1920 Ames ..... 135/68
1,548,889 A * 8/1925 King ..... 135/82
2,767,420 A * 10/1956 Riccio ..... 16/24
3,349,425 A * 10/1967 Rabelos ..... 16/44
3,699,609 A * 10/1972 Spatz ..... 16/44
4,103,391 A * 8/1978 Thomsen ..... 16/33
5,001,808 A * 3/1991 Chung ..... 16/18 CG
5,711,335 A * 1/1998 Carpinella ..... 135/77
5,810,038 A * 9/1998 Carpinella ..... 135/77
5,957,420 A 9/1999 Wang
6,473,935 B1 * 11/2002 Cherukuri ..... 16/33

FOREIGN PATENT DOCUMENTS

| | | |
|---|---|---|
| DE | 3135296 A1 | 9/1981 |
| FR | 1.100.895 | 3/1954 |
| GB | 1130005 | 1/1967 |
| SE | 433432 | 5/1984 |

* cited by examiner

*Primary Examiner*—Leslie A. Braun
*Assistant Examiner*—Kofi Schulterbrandt
(74) *Attorney, Agent, or Firm*—Samuels, Gauthier & Stevens, LLP

(57) ABSTRACT

The present invention refers to a resilient glide for a chair's leg for minimizing the noise that normally occurs when a chair is moved along a floor. The glide comprises a flexible element with a small contact area against the floor in order to minimize friction. The flexible element comes off from a contact surface for the chair's leg arranged in a sleeve intended to surround the leg and is forming an integral part of said sleeve.

10 Claims, 3 Drawing Sheets

FURNITURE LEG GLIDE

This is a continuation of copending application International Application PCT/SE01/00299 filed on February 14, 2001 and which designated the U.S.

TECHNICAL FIELD

The present invention relates to a furniture leg collar intended to be attached to a chair leg and thereby eliminate the scraping noise when moving the chair along a floor surface.

The object of the present invention is to obtain a simple and rational chair leg collar by means that substantially eliminates the scraping noise obtained by the movement of the chair along a floor surface.

BACKGROUND OF THE INVENTION

It is previously known that furniture legs, in particular chair legs reduce the vibration noise, which occurs at movement/displacement along a floor surface of the furniture. The noise is disturbing in offices where a number of people are working, such as school rooms, office landscapes, conference rooms, and the like, in particular if several furniture are moved simultaneously, such as at pauses and breaks.

SE-C-8106653-2 discloses a device comprising a vibration inhibiting elastic body provided with a friction reducing coating, the device being applied to every furniture leg provided with a foot, and whereby the vibration inhibiting body is compressed under the weight of the furniture, so much that the coating will be placed within a groove in the foot which is designed with an abutting surface surrounding the body and the coating whose surface is the contact area to the bedding.

DE-A-19 801 509 disclose a device where a spring-loaded ball is situated in the chair or furniture leg, whereby, however, the object is primarily to facilitate movement of the furniture on the rolling body/ball.

U.S. Pat. No. 1,839,593 discloses a spring-loaded sliding body that is arranged in a foot which is intended to be nailed into a leg of a chair/furniture.

EP-A-0 572 310 discloses a device eliminating static electricity to be placed on a leg of a furniture/chair, whereby a spring-loaded ball is arranged as contacting means.

The various solutions described herein regarding the problem of reducing friction noise use means that include complex structures that require advanced manufacturing and/or application, which leads to high costs for the product and thereby a reduced motivation to use the same.

The present invention intends to solve this problem.

DESCRIPTION OF THE PRESENT INVENTION

It is now possible to be able to solve the problem of the prior art by means of the present invention, which is characterized by the use of a flexible and bendable element having a small contact surface against a floor surface. The flexible element starts from an abutment surface of a cap arranged around a leg of a chair, where the abutment surface is intended for the same floor surface. The flexible element is a material integrated part of the cap.

Further characteristics are evident from the accompanying claims.

By means of the present invention a very simple unit is obtained which is easily applied onto a leg of a chair, which can be varied to size and form in a simple way in connection with the manufacture of a tool therefore and which in a rational way solves the problem of the prior art with a small contact area and simultaneous friction elimination and thereby elimination of the disturbing friction noise.

The present invention will be described in the following more in detail with reference to a preferred embodiment and with reference to the accompanying drawing, wherein FIG. 1 shows a cross-section of an embodiment of the present invention, and FIG. 2 shows the embodiment according to FIG. 1 seen from above.

Figure 1:
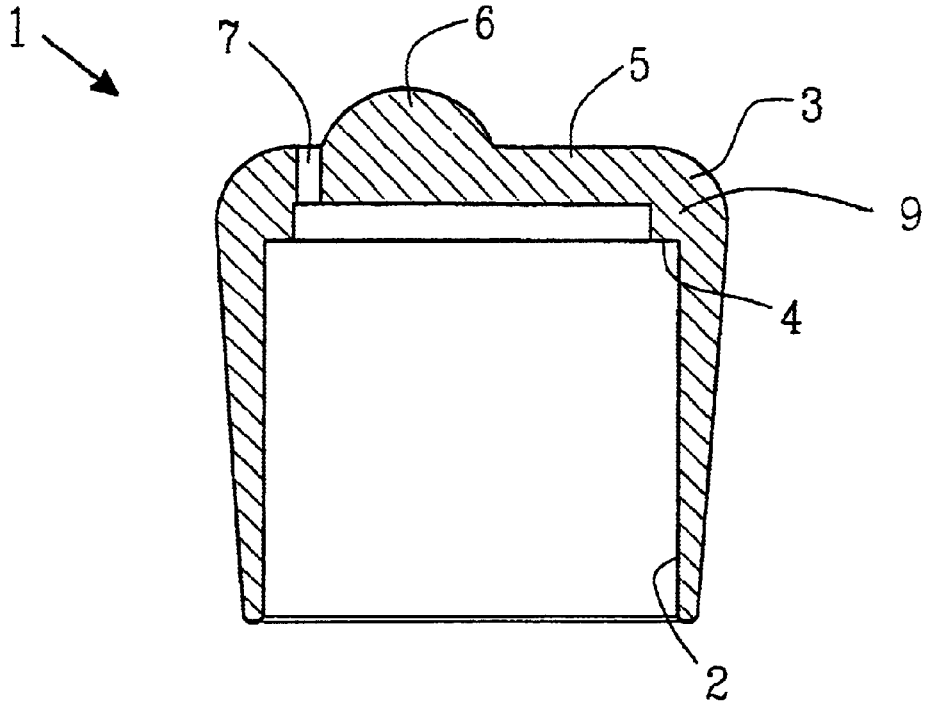

The entity 1 denotes a substantially cylindrical cap of an abrasion resistant and flexible, bendable, and resilient plastic material, such as a polyolefin, e.g., polyethylene (HD; LD), polypropylene, or a two-component polymer. The cap 1 has in its one end 2 an opening to receive a leg of a chair (not shown) and in its other end 3 a partly covered opening. The end 3 has a substantially perpendicular to the cap, inwardly facing, annular abutment surface 4, which is partly intended to receive on the inside of the cap. A leg of a chair introduced into the cap, partly being the abutment area to a floor surface on its outside and against a leg of a chair on its inside. From the annular abutment area a flexible and bendable element in the form of a tongue 5 extends radially inwardly, which on its underneath side has a partly spherical protrusion 6. The tongue 5 and the cap 1 can be manufactured as integrated parts and are of the same material. The tongue 5 is separated from the cap 1 by a peripheral through-going slot 7. The protrusion 6 can also be a cylindrical part.

When the cap 1 has been applied on the respective leg of a chair, the resiliency of the polymer is such that a non-loaded chair will only rest upon the partly spherical protrusions 6. This means a very small abutment area to the floor surface, partly due to the properties of the polymer, where a very small friction exists against the floor surface at displacement. When the chair is loaded ,e.g., one sits down on it, the tongues 5 are pressed upwardly and the chair will substantially rest upon the floor surface along its abutment surface 4.

Figure 2:
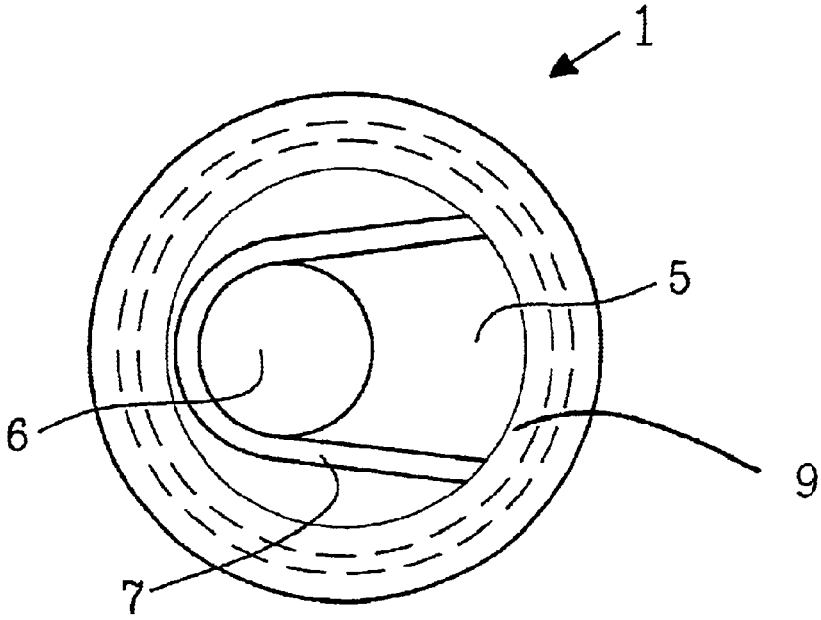
Figure 3:
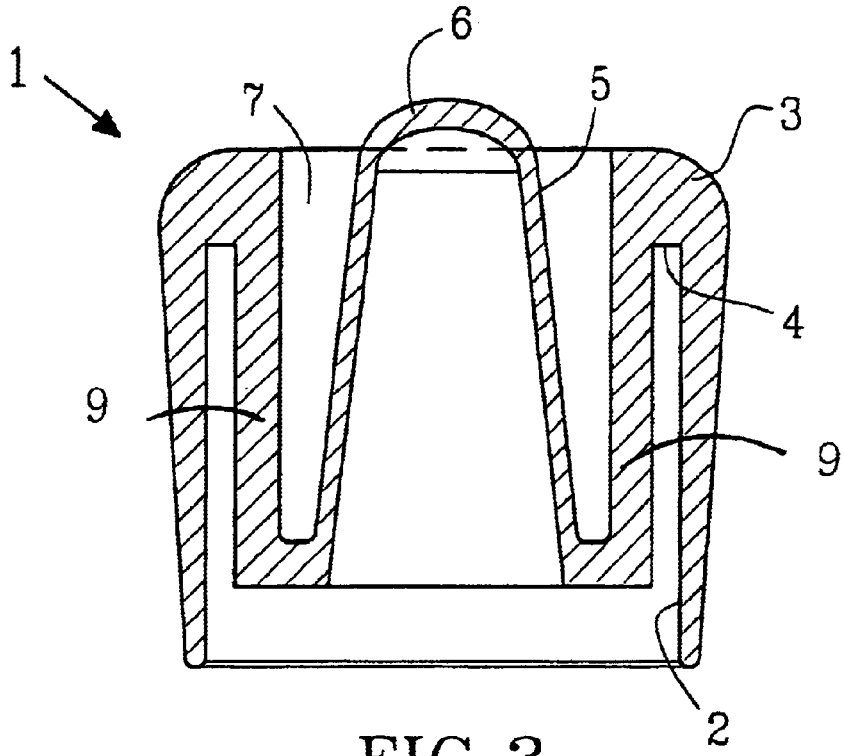
FIG. 3 shows a second preferred embodiment of the invention in a vertical cross-section.
Figure 4:
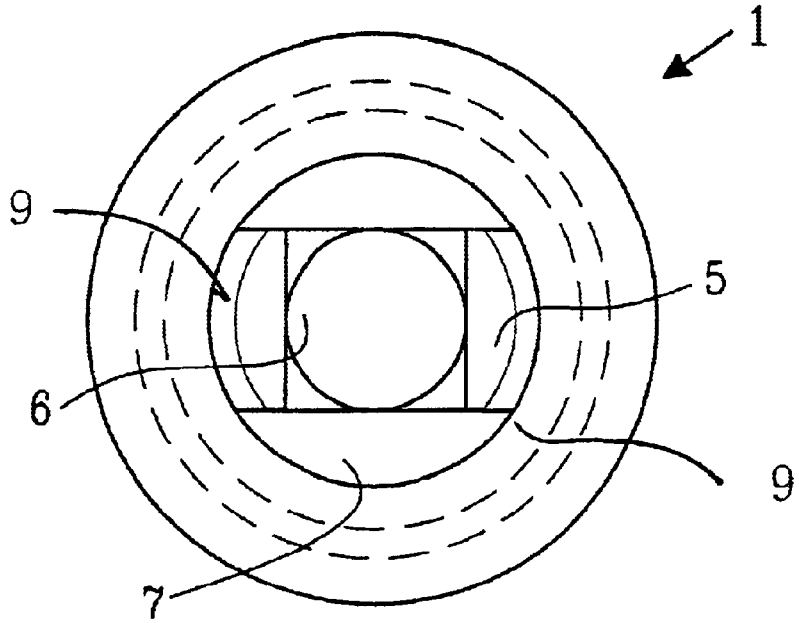
FIG. 4 shows the embodiment of FIG. 3 seen from above.

In FIGS. 1 and 2, it is shown how the elastic element is attached along a line/fastening point 9, and FIGS. 3 and 4 provide an example of a construction, which facilitates more than one fastening point. The choice of number of fastening points depends on the geometry and dimension of the leg of the chair.

Figure 5:
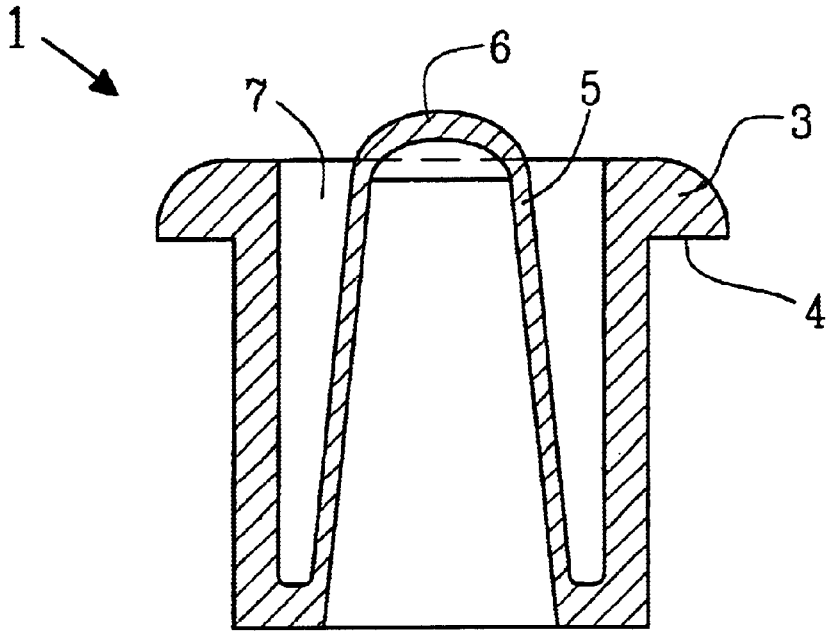
FIG. 5 shows a further, preferred embodiment intended for inside application.
Figure 6:
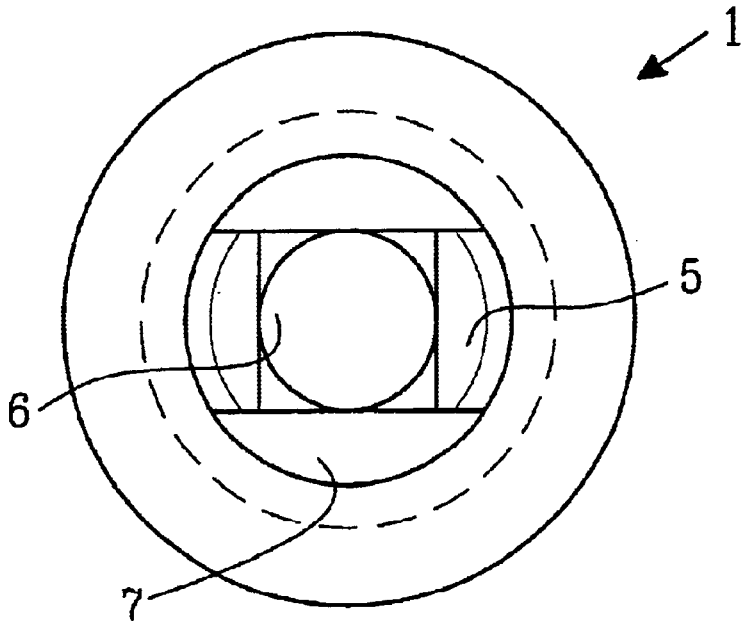
FIG. 6 shows the embodiment of FIG. 5 seen from above.

In FIGS. 5 and 6 a cap to a leg of a chair is shown which shall be mounted on the side of a leg of a chair.

By means of its simplicity the cap 1 with its the element 5 can easily be applied and exchanged after wear out.

It is apparent to one skilled in the art that the diameter and length of the cap 1 can be varied based on the needs of different legs of chairs. The cap 1 can be adopted to different legs of chairs, such as circular, quadratic or rectangular cross-sections. The width and thickness of the abutment surface 4 can be varied to obtain optimal properties, in the same way as the size and filling of the circular, quadratic or rectangular opening of the element 5. In addition, the element 5 can be attached diametrically to the abutment surface 4 to form a bridge from which the protrusion 6 extends from a central point of the bridge. As chairs are often produced in large series, the cost of the cap 1 can be kept low. Also, the cap 1 can be adapted to fit an inside arrangement in the leg of a chair, i.e., the leg of the chair has a cylindrical insert part, whereby the abutment surface 4 is arranged as an outwardly extending collar on the insert part.

What is claimed is:

1. A chair leg glide intended to be attached to a chair leg and thereby to minimize scraping noise associated with the movement of a chair along a floor surface, said chair leg glide comprising a friction minimizing flexible and bendable element having a small contact surface against said floor surface, and an abutment surface of a cap is arranged around a leg of said chair, whereby said flexible and bendable element is an integrated part of said cap and is part of a tongue that extends radially inwardly, said tongue is also attached to the cap, whereby a non-loaded chair will only rest upon the contact surface, which leads to a small abutement area to the floor surface, and causes a small friction only against the floor surface so that when the chair is loaded said flexible element is arranged to be pressed upward, said chair will essentially rest against the floor surface along said abutment surface.

2. A chair leg according to claim 1, wherein the contact surface is a protrusion arranged on said element.

3. A chair leg glide according to claim 2, wherein the protrusion is partly spherical.

4. A chair leg glide according to claim 2, wherein the protrusion is cylindrical.

5. A chair leg glide according to claim 1, wherein tongue is attached in its one end and receiving said contact surface at its other end.

6. A chair leg glide according to claim 1, wherein the element is a unit being attached to the abutment surface in at least two points having a substantially centrally placed protrusion.

7. A chair leg glide according to claim 5, wherein the tongue is attached to the abutment surface.

8. A chair leg glide according to claim 1, wherein the abutment surface is an annular surface being essentially perpendicular to the longitudinal axis of the cap inwardly directed and partly covering the cross-sectional area of the cap.

9. A chair leg glide according to claim 1, wherein the cap with its integrated tongue is manufactured in a steel alloy.

10. A chair leg glide according to claim 1, wherein the cap comprises a plastic material or rubber material.

* * * * *